United States Patent [19]

Sedlák et al.

[11] Patent Number: 4,538,513

[45] Date of Patent: Sep. 3, 1985

[54] MECHANISM FOR THE AUTOMATIC CONTROL OF PRINTING PRESSURES ON PRINTING MACHINES

[75] Inventors: Vaclav Sedlák, Jedovnice; Jaroslav Jiruše, Blansko, both of Czechoslovakia

[73] Assignee: ZVS Adamovske strojirny, koncernovy podnik, Adamov, Czechoslovakia

[21] Appl. No.: 669,812

[22] Filed: Nov. 8, 1984

[30] Foreign Application Priority Data

Nov. 9, 1983 [CS] Czechoslovakia ..... 8255-83

[51] Int. Cl.[3] ..... B41J 45/00

[52] U.S. Cl. ..... 101/76; 101/218; 101/144; 101/247

[58] Field of Search ..... 101/74, 76, 77, 83, 101/137, 139–140, 143–145, 247, 218

[56] References Cited

U.S. PATENT DOCUMENTS

| | | | |
|---|---|---|---|
| 2,773,445 | 12/1956 | Wood | 101/218 |
| 2,821,911 | 2/1958 | Mestre | 101/218 |
| 2,909,117 | 10/1959 | Crissy | 101/137 |
| 3,584,578 | 6/1971 | Jurny | 101/218 |
| 3,624,730 | 11/1971 | Gottscho | 101/76 |
| 4,041,862 | 8/1977 | Jiruse | 101/144 |
| 4,248,145 | 2/1981 | Patyk et al. | 101/76 X |
| 4,353,297 | 10/1982 | Fujisawa et al. | 101/144 X |

FOREIGN PATENT DOCUMENTS

| | | | |
|---|---|---|---|
| 151387 | 9/1982 | Japan | 101/74 |
| 1076634 | 7/1967 | United Kingdom | 101/76 |

*Primary Examiner*—E. H. Eickholt

[57] ABSTRACT

Mechanism for the control of printing pressures in a printing machine, particularly the printing pressures exerted by accessory devices such as a unit for the numbering of the printing articles. A single mechanism controls the single functions of the printing mechanism, such as the bringing into pressure engagement and the disengagement of the printing cylinders, the control of the inking unit, the control of the numbering device, and also possibly of other mechanisms. Around the circumference of a double-cam, there are arranged a plurality of two-arm levers. A first two-arm lever, which is pivotally arranged on a fixed, pivot pin is connected by means of a first pull rod with the mechanism of the inker unit. A second two-arm lever is journalled on a second fixed pivot, the second two-arm lever being connected by means of a second pull rod with a mechanism for imposing printing pressure and releasing such printing pressure. A third two-arm lever is pivotally mounted on a third fixed, pivot and is connected by the means of a third pull rod with the mechanism for the progressive advance of the numbers printed by the numbering devices.

5 Claims, 4 Drawing Figures

MECHANISM FOR THE AUTOMATIC CONTROL OF PRINTING PRESSURES ON PRINTING MACHINES

This invention relates to a mechanism for the control of printing pressures on printing machines, particularly the controlling of such pressures which are exerted by accessory devices.

On printing machines, the mechanism for the control of printing pressures is designed for putting the printing cylinders into printing pressure engagement and for withdrawing them from such engagement. The mechanism for the control of the printing pressure exerted by an accessory numbering device serves for the control of the printing pressure exerted by the numbering roller against the impression roller, and for the disengagement of the numbering roller from the impression roller.

A control mechanism for the accessory device also applies inking rollers of the inker unit to the numbering roller, and then disengages the inking rollers from the numbering roller.

The present invention has among its purposes the provision of an automatic control for the printing pressures in such manner that one control mechanism controls the single functions of (a) putting the printing cylinders into printing pressure engagement and for withdrawing them from such engagement, (b) the control of the inking rollers of the inker unit, (c) the control of the numbering elements of the numbering unit, and (d) also any other auxiliary mechanisms which may be required. The mechanism of the invention has to be arranged in such matter that the above described single functions will be carried out at predetermined times according to the working cycle of the printing machine, with the possibility, on the one hand, of manual control of the mechanism, and on the other hand, of the control of the printing machine by means of automatic means such as an electromagnet or solenoid.

The simplest hitherto known mechanisms for the above-mentioned functions of a printing machine are controlled by hand. In an offset printing machine, the offset cylinder is manually put into engagement with the blanket cylinder and with the impression cylinder, whereby the printing cylinders are engaged with printing pressure, after which there follows the engagement with the printing cylinder or printing cylinders by the one or more accessory devices.

There are also known devices which place accessory devices into printing pressures with the printing cylinders in dependence upon the engagement of the printing pressures of the printing machine, the inking roller or rollers of the inking unit of the accessary device being manually put into engagement with numbering elements.

A disadvantage of the above described prior devices is that when printing pressures are applied manually, it is not done adequately and in conformity with the function of the printing machine. This disadvantage is particularly inconvenient for the numbering of checks and similar valuable papers, wherein an accurate and failure-free sequence of the function of the printing machine is a basic requirement.

Other known devices employed on modern printing machines secure the said functions by means of independent mechanisms for the control of the inking rollers of the inker unit and for the putting into engagement with printing roller of the numbering elements in the numbering devices.

The disadvantage of these independent mechanisms is their complicated construction; as a consequence the provision of an automatic sequence of the functions of the auxiliary or accessory devices of the basic printing machine also is very complicated and failure-prone.

A further known device for the control of printing pressures in a printing machine is manually controlled by means of a Belden control wire. Such device is provided with a simple cam, so that the control lever has to be returned into its rear or inactive position by means of a spring. The blocking has to be controlled by means of an independent mechanism. The control cam on this device has three idle or at-rest positions for the two functions which its controls.

The disadvantage of the above described prior art device is that it has for the two functions which it controls three at-rest positions on the cam, whereby the reverse control of the mechanisms by means of springs provides strokes into the inside of the printing mechanism which are not required. Further, such prior device does not provide for an automatic control of the accessory mechanism or mechanisms.

The above outlined disadvantages of the prior art control mechanisms are avoided by a mechanism according to the present invention. In such mechanism, around the circumference of a double-cam there are arranged three two-arm levers, the first two-arm lever being swingably arranged on a first fixedly mounted pivot pin and being connected by means of a first pull rod with the mechanisms of an inker unit. The second two-arm lever is mounted on another fixed pivot pin, which is rotatably arranged in a bushing or sleeve, whereby the second pivot is provided with a clamp which is connected by means of a second pull rod with the printing pressure providing mechanism. A third two-arm lever, which is swingably arranged on a third fixed pivot pin, is connected by means of a third pull rod with mechanism for the control of the numbering element or elements in a numbering printing device.

The first two-arm lever is provided with a first cam-following roll and with a second cam-following roll, the second two-arm lever is provided with a third cam-following roll and a fourth cam-following roll; the third two-arm lever is provided with a fifth cam-following roll and with a six cam-following roll. The first roll, the third roll, and fifth roll follow the outer peripheral surface of a first cam part of the double-cam, and the second roll, the fourth roll, and the sixth roll are in engagement with and follow the second cam part of the double-cam.

On each cam part of the double-cam there are provided at least two at-rest positions. On the double-cam, there is swingably arranged a link which is provided with a stop pivot, such stop pivot being in alternative engagement with a catcher lever and a blocking lever which are interconnected by means of a connecting pull rod. The blocking lever is swingably arranged on a pivot pin which fixed on a side wall of the printing machine, whereby the blocking lever is connected with a electromagnet or solenoid by means of a carrier pin and a stub shaft.

The advantage of this mechanism is that all functions are carried out automatically without the necessity of any interaction of the operator, the device providing the possibility of operating the various controls automatically by the mechanism or manually.

Another advantage of the mechanism of the invention is the convenient location of the lever transmissions around the central double-cam, by means of which there is secured the required time sequence of the single functions according to the working cycle of the printing machine.

A further advantage of the mechanism according to the invention is its universal possibility of use also for the control of other mechanisms on the printing machine, that is, besides the control of the printing pressure of the inker unit and the control of the numbering devices; thus the mechanism control can the variator of the drive of the printing machine and the like in the required cycles and time intervals of the working cycle of the printing machine; the number of the functions performed by the mechanism is given by the number of the two-arm levers, their arrangement in sequence, and their connection to the double-cam.

Another advantage of the mechanism in accordance with the invention is that the connection of the two-arm lever and the blocking lever by means of a rigid pull rod guarantees a reliable starting and stopping of a given function, and by this insures the reliably of the whole printing mechanism including its accessories.

A further advantage of the mechanism according to the invention is that the necessary time retardation between the function of the basic machine and the function of the accessory devices can be achieved by a convenient ratio between the one-position pawl and a groove on the carrier gear which selectively cooperates therewith. The mechanism does not, therefore, require further elements, for example, a retardation relay for securing the necessary retardation or time-spacing of the functions of the device. This fact provides a further advantage in that the time between the switching-on of the electomagnet or solenoid and the engagement of the pawl into the groove is sufficiently long, and for that reason the connection of the pawl with the carrier gear is not critical relative to the time which is necessary for the operation of the plunger of the solenoid.

A further advantage of the invention is that the whole mechanism moves only while putting a particular function into operation or during the stopping of such function, such as for providing printing pressure and subsequently relieving printing pressure.

In the working position, the whole control mechanism is in its at-rest position, i.e. except for the rotation of the carrier gear no other element moves. The mechanism, therefore, does not require pressure lubrication, so that its useful life span is long.

One of the possible embodiments of the mechanism of the invention for the automatic control of printing pressures is schematically illustrated in the accompanying drawings, wherein.

Figure 1:
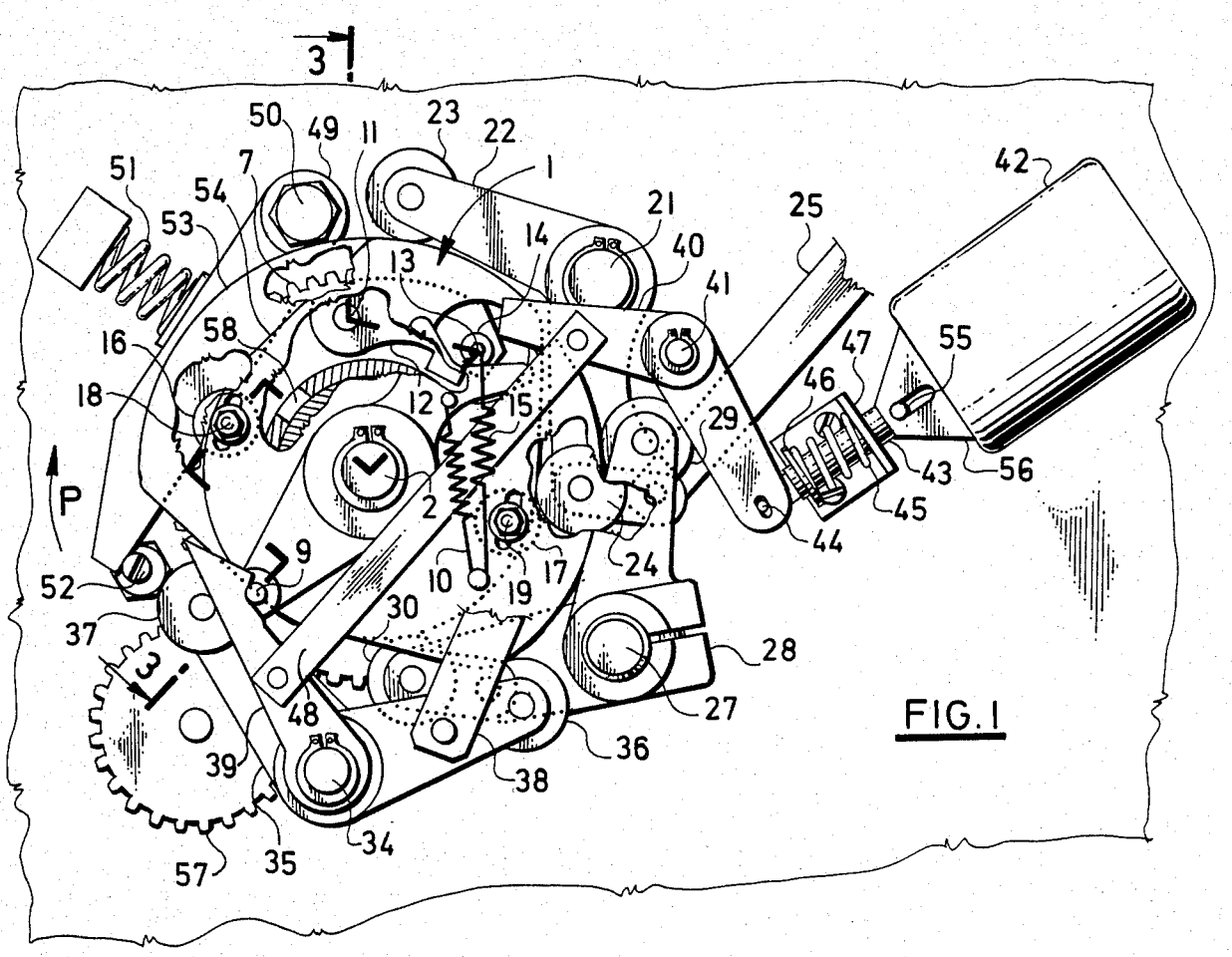
FIG. 1 illustrates a preferred embodiment of the control mechanism in a front view, the parts of the control mechanism being in the position which they assume when there is no printing pressure being required by the printing machine or any of its accessories.
Figure 2:
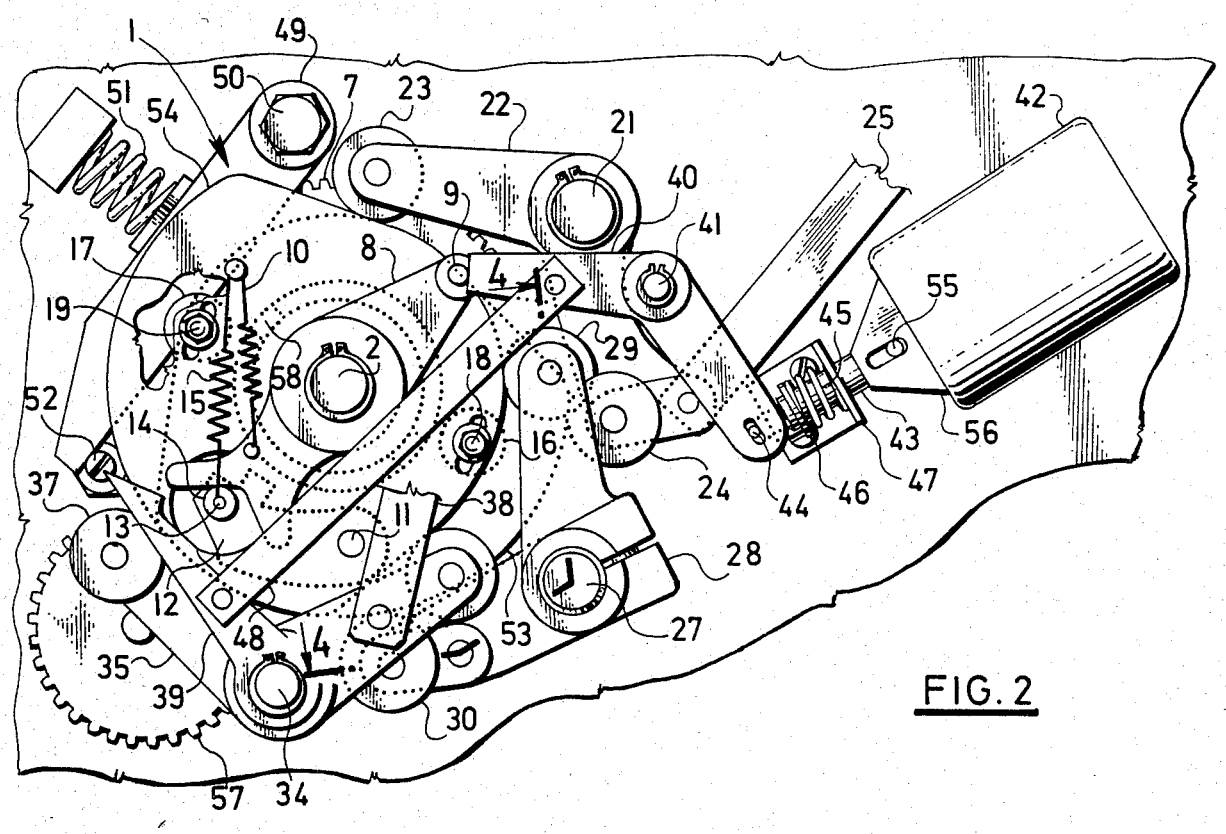
FIG. 2 is a view similar to FIG. 1, but with the parts of the control mechanism being in a position which they assume while printing pressure is being imposed upon the printing members.
Figure 3:
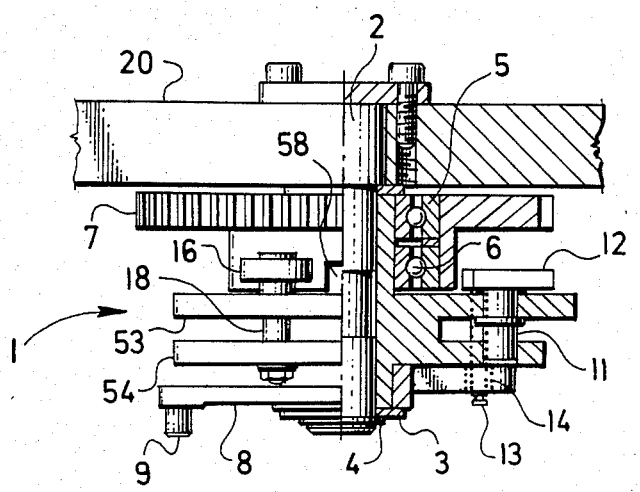
FIG. 3 is a view in section of the device when the parts thereof are in their at-rest position, the section being taken on broken line 3—3 in FIG. 1.

Turning first to FIGS. 1 and 3, it will seen that a double-cam 1 having a first wheel cam part 53 and second wheel cam part 54 parallel thereto is mounted for rotation upon a stub shaft 2 which is fixedly secured to and projects from a side wall 20 of a printing machine, which is not otherwise shown. The double-cam 1 is secured against axial escape from the stub shaft 2 by means of a washer 3 and a securing spring ring 4. The double-cam 1 has a hub or sleeve extending therefrom (upwardly in FIG. 3). Rotatably mounted upon such sleeve upon double-row ball bearings 5, 6 mounted thereon, is a carrier gear 7 having a sleeve-like hub shown projecting downward in FIG. 3. Gear 7 rotates freely with respect to the double-cam 1 unless the two are coupled together by a selectively operatable pawl 12 engaging into one of two oppositely located grooves 58 in the hub of the carrier gear 7 (FIGS. 1 and 2). The carrier gear 7 is in constant mesh with a drive gear 57. On a short, downwardly (FIG. 3) extending hub of the double-cam there is double-arm lever 8 which is provided at its left-hand end with a stop pivot 9 and on its right-hand end (FIG. 1) with a fork formation 9*a* having arms spaced at a large angle, a coil tension spring 10 acting between the end of lever near formation 9*a* and cam part 54 constantly urging the lever to rotate in a counterclockwise direction of FIGS. 1 and 2. On pivot pin 11, mounted on the double-cam 1, there is journalled an arm 12' having a pin 13 on its outer end. A roll 14, journalled on pin 13, is constantly urged into the crotch of the fork formation 9*a* by a coil tension spring 15, which acts between the double-cam 1 and arm 12'.

The double-cam 1 is provided with a first positioning roll 16 which is arranged on a pivot pin 18 and with a second positioning roll 17 which is arranged on a pivot pin 19, rolls 16 and 18 being positioned at equal distances from the center of cam 1 and 180° apart.

Figure 4:
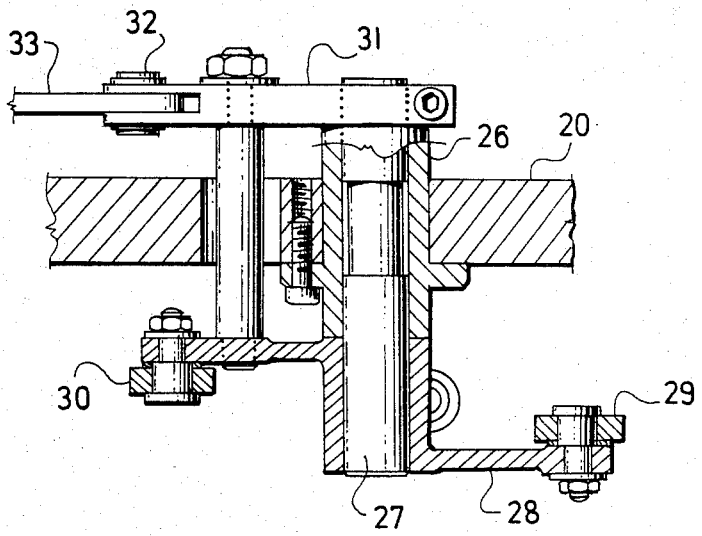
FIG. 4 is a partial section of the device when it is in its printing pressure directing condition, such section being taken along the line 4—4 in FIG. 2.

On a first pivot pin 21, which is fixed to the side wall 20 of the printing machine, there is journalled a first two-arm lever 22 which is provided with a first cam-following roll 23 and with a second cam-following roll 24. The first roll 23 rolls on the periphery of the first part 53 of the double-cam 1, and the second roll 24 rolls on the periphery of the second part 54 of the double-cam 1. On the first two-arm lever 22, there is a first pull rod 25 pivotally attached at one end thereof, pull rod 25 being for the control of the inking rollers of the inker unit. As shown in FIG. 4, there is also fastened to the side wall 20 of the printing machine a bushing 26, in which there is rotatably mounted a second pivot shaft 27. One end of shaft 27 there is fixed a second two-arm lever 28 which is split at the end connected to shaft 27 and is formed like a clamp. The second two-arm lever 28 is provided with a third cam-following roll 29 and a fourth cam-following roll 30. On the other end of the second pivot shaft 27 there is fixed a clamp 31 which is connected by means of a connecting pivot 32 with a second pull rod 33 for the putting of the printing parts of a numbering printing roller (not shown) into printing engagement, and for the removal of the numbering roller from such printing engagement.

On side wall 20 of the printing machine there is also fastened a third stub shaft 34, on which there is rotatably mounted a third two-arm lever 35 which is provided with a fifth cam-following roll 36 and with sixth cam-following roll 37. The third two-arm lever 35 is connected with a third pull rod 38 for the control of a mechanism (not shown) which controls the progressive changing of the numbers on the numbering devices. On the third stub shaft 34 there is also arranged a catcher lever 39 which is provided with a recess 9' into which there is selectively engaged the stop pivot 9 of the link or arm 8. A blocking lever 40 in the shape of a bell crank is rotatably mounted on a stub shaft 41 which is fastened to the side wall 20 of the printing machine for the blocking of the parts wherein the numbering roller exerts printing pressure upon the printing roller. The outer arm of the blocking lever 40 is controlled by the plunger of an electromagnet or solenoid 42 by means of a motion limiting connecting means including a guide pin 55 sliding in a slot in a guide sheet or plate 56. The plunger of the solenoid is connected to blocking lever 40 by a cross pin 44.

The shifting of the plunger of the solenoid 42 is secured by a coil compression spring 45 which is arranged on the stub shaft 43 between a ring 46 and support 47. The position of the stub shaft 43 is limited by guide pin 55 which is arranged in the slot of a guide sheet or plate 56. The guide pin 55 is attached in the stub shaft 43 and the guide sheet or plate 56 is attached to the plunger of the solenoid 42. The inner arm of the blocking lever 40 is connected by means of a connecting pull rod 48 with the catcher lever 39, pull rod 48 being pivotally connected to the mid-points of the inner arm of blocking lever 40 and the catcher lever 39. A positioning lever 49 rotably mounted on pivot 50, which is fastened in the side wall 20 of the printing machine, is provided with a recess 16' for the entering of the first cam-following roll 16 (FIG. 1) and of the second cam-following roll 17 (FIG. 2). The positioning lever 49 is pressed onto an eccentric 52 by means of a coil compression spring 51, whereby the position of said positioning lever 49 is limited by the eccentric 52.

The above described mechanism according to the invention operates as follows:

Before the beginning of the printing operation, the printing cylinders of the printing machine are in a position wherein they are disengaged from each other, and on the accessory device the numbering roller thereof is in a position remote from the impression roller. The inking rollers of the inker unit are not in contact with the printing elements, and the number changing elements in the numbering device are in a position in which they do not emit an impulse for the changing of numbers.

At the beginning of the printing operation the printing mechanism is its initial position, as shown in FIG. 1. There is now given an electrical impulse which is derived from the control center (not shown) of the machine for the switching-on of the solenoid 42. This function can also be performed manually by means of a switch (not shown). By the switching-on of solenoid 42, the blocking lever 40 is turned into the blocking position, and by means of the connecting pull rod 48 the catching lever 39 releases the stop pivot 9 on the arm or arm 8, whereby there is caused a turning of the arm 8 and the cam-following roll 14 is released; by such action the pawl 12 has its tooth seated in one of the grooves 58 on the carrier gear 7. By this action, the carrier gear 7 is now drivingly connected with the double-cam 1. The double-cam 1 is now turned through a 180° until the stop pivot 9 engages the blocking lever 40. With the such action, the arm 8 is blocked; this secures the lifting of the cam-following roll 14 by means of the oblique surface of the arm 8, and by such action there is also produced the lifting of the pawl 12 from the groove 58 on the carrier gear 7. The double-cam 1 then ceases to rotate, whereby its position is secured by the engagement of the positioning pawl 17 into the recess which is provided in the positioning lever 49. The parts of the control mechanism are now in the positions illustrated in FIG. 2. During the turning of the double-cam 1 in the direction of the arrow "P" in FIG. 1, the following actions takes place:

(a) By means of the first two-arm lever 22, of the first pull rod 25, and by means of further connecting elements (not shown) the inking rollers of the inker unit are placed into engagement with the printing elements.

(b) By means of the second two-arm lever 28, the second pivot 29, the clamp 31, the connecting pivot 32, and second pull rod 33, and by means of a further connecting mechanism (not shown) the numbering rollers are put into printing pressure engagement with the impression roller.

(c) By means of a third two-arm lever 35 by the third pull rod 38, and by means of a further connecting mechanism (not shown) the control elements for the changing of the numbers in the numbering devices are energized.

Upon an interruption, or upon the finishing of the printing work, there is emitted an electrical impulse from the control center of the printing machine for the shifting of the solenoid 42, by means of which the blocking lever 40, stop pivot 9, and arm 8 are released. By this, the arm 8 is turned and releases the cam-following roll 14 of the pawl 12, the tooth of which engages into one of the grooves 58 which are provided in the hub of the carrier gear 7. By this, the carrier gear 7 is drivingly connected with a double-cam 1. The double-cam 1 is turned through 180° until the stop pivot 9 is behind the tooth of the catcher lever 39. At this moment, the cam-following roll 14 is shifted on the oblique surface of the arm 8, and enables the shifting of the tooth of the pawl 12 out of the groove 58 in the hub of the carrier gear 7. As a result, the rotation of the double-cam 1 is stopped. This position is secured by the engagement of the cam-following roll 16 into the recess which is provided in the positioning lever 49. The described turning of the double-cam 1 through 180°, there are produced the following functions:

1. the disengagment of the inking rollers of the inker unit, 2. the disengagement of the numbering roller from its printing pressure engagement, and 3. the disengagement of the elements which secure the progressive changing of the numbers in the numbering devices.

The position of the blocking lever 40, during the disengagement of printing pressure, is dictated by the engagement of the guide pin 55 with the lower end of the slot in of the guide sheet or plate 56 by the effect of the pressure spring 45 (FIG. 1). The position of the blocking lever 40 while there is printing pressure between the printing rolls of the machine, is determined by the engagement of the guide pin 55 on the end of the plunger of the solenoid 42 with the upper end of the slot in the guide sheet or plate 56 (FIG. 2).

To complete the disclosure of the apparatus of the invention:

1. The inking rollers of the inker unit may be those described and shown in coassigned UK Pat. No. 1,373,179 of Adamovske Strojirny.

2. The numbering rollers of the numbering unit may be those used and described in connection with Prospects of Machines Adast Nos. 414 and 714, which are exported to the United States.

3. The unit for the changing of the members in the numbering unit may be that described in West German Pat. No. 1,579,068.

A printing machine to which the apparatus of the invention can be applied is disclosed in coassigned U.S. Pat. No. 3,584,578 of Adamovske Strojirny.

Although the invention is described and illustrated with reference to a single embodiments thereof, it is to be expressly understood that it is in no way limited to the disclosure of such preferred embodiment but is capable of numerous modifications within the scope of the appended claims.

We claim:

1. A mechanism for the automatic control of printing machines, particularly accessory devices for additional printing, and wherein the single functions are carried out in predetermined intervals according to the working cycle of the printing machine, the mechanism having a double-peripheral cam about which there are arranged a plurality of two-arm levers mounted on fixed pivots, connected to a first two-arm lever which is swingably arranged on a first pivot there is connected by means of a first pull rod the mechanism of an inker unit, a second two-arm lever being mounted on a second pivot, the second two-arm lever being rotatably mounted on a fixed structure of the printing machine, the second pivot being connected by means of a second pull rod with the mechanism for producing printing pressure, and a third two-arm lever which is swingably arranged on a third pivot, the third two-arm lever being connected by means of a third pull rod with the mechanism for the progressive changing of the numbers in the numbering devices of the printing mechanism.

2. A mechanism for the automatic control of the printing pressures according to claim 1, wherein the first two-arm levers are provided with a first cam-following roll and with a second cam-following roll, wherein the second two-arm lever is provided with a third cam-following roll and with a fourth cam-following roll, and wherein the third two-arm lever is provided with a fifth cam-following roll and with a sixth cam-following roll, the first, third, and fifth rolls roll upon and cooperate with a first peripheral cam path of the double-cam, and the second, fourth, and sixth cam-following roll, roll upon and cooperate with the second cam path of the double-cam.

3. A mechanism for the automatic control of printing pressures according to claim 1, wherein each cam path of the double-cam is provided in at least two places with an at-rest position.

4. A mechanism for the automatic control of the printing pressures according to claim 1, wherein on the double-cam there is swingably arranged which is provided with a stop pivot, the stop pivot being in an alternating engagement with a catcher lever and with a blocking lever rotatably mounted on respective fixed pivot pins, the catcher lever and blocking lever being mutually interconnected by means of a connecting pull rod.

5. A mechanism for the automatic control of the printing pressures according to claim 4, wherein the blocking lever is swingably arranged on a pivot pin which is fixed on the side wall of the printing machine, the blocking lever being connected by a motion-limiting connecting means to the plunger of a solenoid.

* * * * *